United States Patent [19]

Fagerlund

[11] 3,933,256

[45] Jan. 20, 1976

[54] SHIP'S LOADING RAMP

[75] Inventor: Per Fagerlund, Torslanda, Sweden

[73] Assignee: Navire Cargo Gear International AB, Goteborg, Sweden

[22] Filed: Apr. 22, 1974

[21] Appl. No.: 463,167

[30] Foreign Application Priority Data

May 7, 1973 Sweden ..... 7306337

[52] U.S. Cl. ..... 214/15 R; 14/71 R; 182/82

[51] Int. Cl.[2] ..... B65G 11/00

[58] Field of Search ..... 14/71, 72; 182/48, 86, 182/97, 98, 82; 214/15 R

[56] References Cited

UNITED STATES PATENTS

| | | | |
|---|---|---|---|
| 2,617,131 | 11/1952 | Harris | 14/71 |
| 3,411,169 | 11/1968 | Guerke | 14/71 |
| 3,580,404 | 5/1971 | Moser | 14/71 |
| 3,687,308 | 8/1972 | Apelstrand | 14/71 |
| 3,747,354 | 7/1973 | Macomber | 14/71 |
| 3,846,860 | 11/1974 | Kummerman | 14/71 |

*Primary Examiner*—Relnaldo P. Machado
*Attorney, Agent, or Firm*—Holman & Stern

[57] ABSTRACT

A ship's loading ramp has two side beams interconnected by travelling tracks with the beams and the tracks being divided in two portions connected by hinges. Wires for operating the ramp are connected to balancing arms and, one such arm is connected to each beam at the hinges. An actuator is fitted to adjust the angular position of the balancing arm with respect to the portions of the pertaining beam during raising and lowering operations.

4 Claims, 2 Drawing Figures

SHIP'S LOADING RAMP

BACKGROUND OF THE INVENTION

The present invention relates to a ship's loading ramp, especially of the type adapted to extend outwardly at an angle to the longitudinal axis of the ship, and being designed to permit trucks to travel into the stern of the ship from a quay along the ship's side. Such a ramp would, if it was not divided, be very long and in the swung-up position extend well above the ship's superstructure.

DESCRIPTION OF THE PRIOR ART

Ramps have been proposed which include an inner portion and an outer portion, hingedly interconnected so the outer portion may be folded down along the inner portion, when the ramp is raised to the vertical position.

U.S. Patent No. 2,687,308 shows a ramp including unitary side beams carrying divided travelling tracks, but these beams have, due to their height in the stowed position, a detrimental influence upon the stability of the ship, especially if of small size. Beside their own, considerable weight, these beams will, at their outer ends, support certain operating gear for manipulating the outer travelling track.

OBJECT AND SUMMARY OF THE INVENTION

The object of the present invention is to improve the design, whereby the height of the side beams may be reduced to about one half of what was considered necessary heretofore, while simultaneously an operating gear for the outer travelling track portion together with the outer portion of the side beams will be simplified. This means a considerable reduction of the weight, without any loss of the favorable working properties of the ramp.

A loading ramp according to the invention includes two spaced parallel side beams swingably connected to the ship and carrying travelling track which interconnects the side beams, with said side beams and said tracks being divided into inner and outer portions interconnected by transverse hinge means located about midway of the ramp, so the inner and outer portions of the ramp, by the aid of winch means operably related to each side beam, about at the midway hinge means, may be folded together and swung to a vertical, stowed position on board the ship, and is characterized in that sheaves for guiding the wires of the winch means are fitted at balancing arms, which are pivotably mounted at each side beam, adjacent to the midway hinge means, with said arms being longer than the height of the pertaining beam portion at the hinge means, and that an actuator mounted at either of the portions of the pertaining side beam is adapted to adjust the angular position between the balancing arm and the outer beam side portion.

BRIEF DESCRIPTION OF THE DRAWING

One embodiment of the invention will below be described with reference to the accompanying drawing illustrating a preferred embodiment of the invention in which.

DESCRIPTION OF A PREFERRED EMBODIMENT

Figure 1:
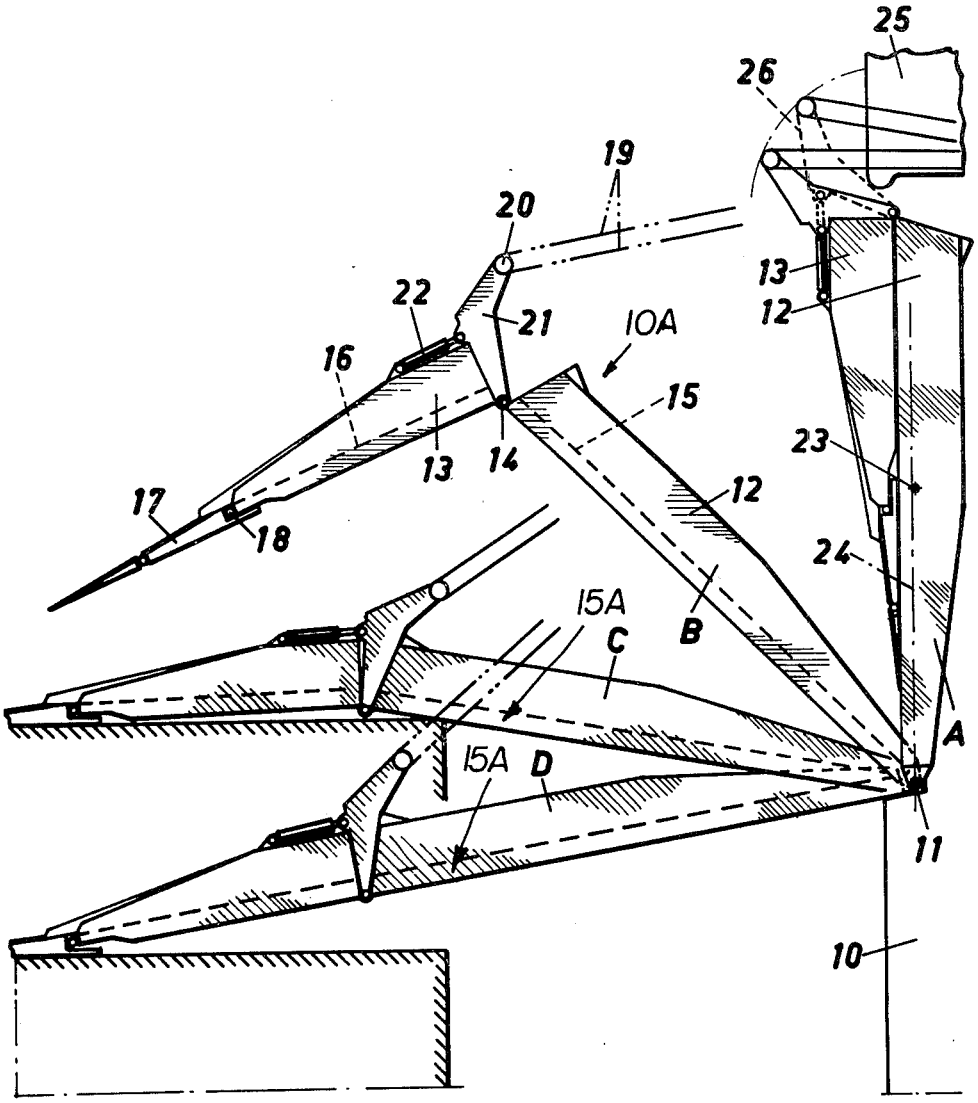
FIG. 1 is a diagrammatic side view showing a ramp according to the invention in different positions between the stowed and fully unfolded positions.
Figure 2:
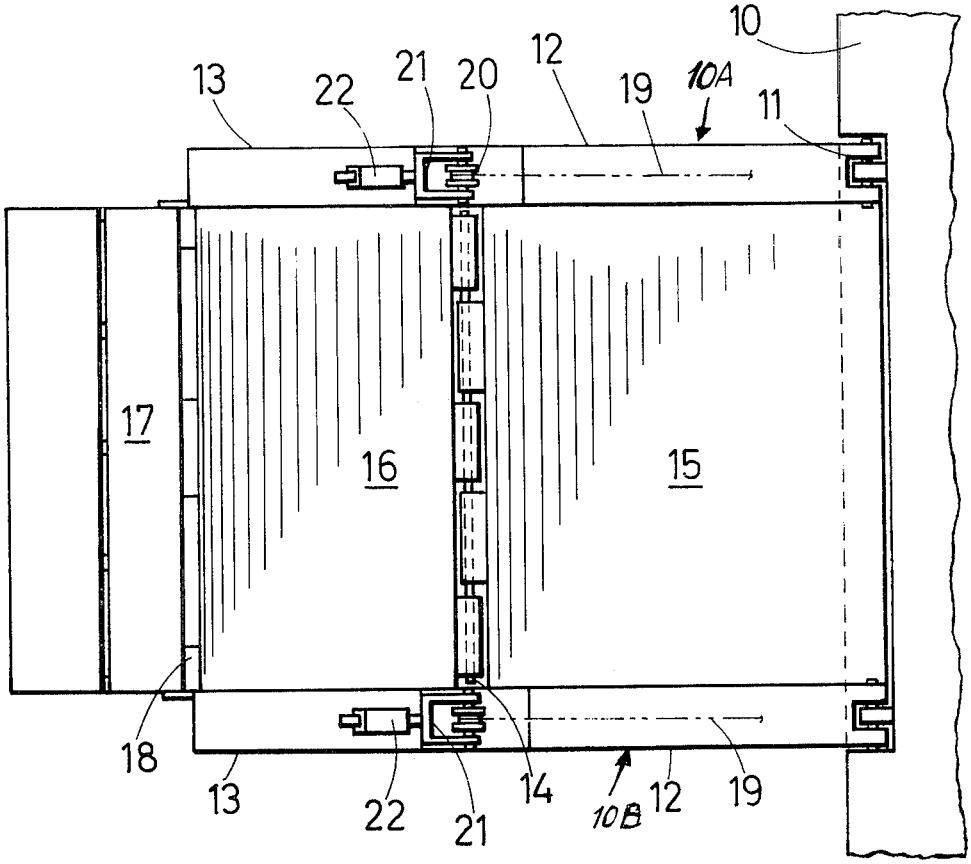
FIG. 2 is a top view of the ramp according to FIG. 1.

The stern of a ship is denoted by 10, and in connection to an opening therein a loading ramp is fitted, which is swingable about an inner hinge means 11.

The ramp is composed of two, spaced mainly parallel beams 10A, 10B each side beam including an inner portion 12 and an outer portion 13, respectively. The portions 12, 13 of each beam are joined by midway hinge means 14 which, in the conventional manner, is located at the lower edge of the side beams. The inner and the outer portions 12 and 13 of the two side beams are transversely interconnected by travelling track inner and outer portions 15, 16, defining a track 15A. The travelling track proper is thus also divided adjacent to the axis of the hinge means 14, and the travelling track portions may likewise be joined by hinge means.

A drive-up flap 17 is pivotably fitted up to the free ends of the outer beam portion 13 by means of further hinge means 18. This flap is adapted, automatically to adjust itself to the inclination of the quay, irrespective of the angle at which the side beams rest thereon, and will also aid in distributing the load to be transferred at the ends of the beams over an enlarged area.

The ramp is operated by the aid of winch means, not shown in detail, but indicated by a wire loop 19 for each side beam. In other words the winch means will lift at each side beam 10A.

A block 20, possibly a multiple sheave one if the wire tackle includes several running wire parts, is fitted at the end of a balancing arm 21, pivotably mounted at each side beam 10A, 10B, adjacent to the midway hinge means 14. Hence, there are two arms 21, each balancing arm has a length exceeding the height of the beam at this end, and is preferably journalled about the axis contained in the midway hinge means to be aligned with the portions of the pertaining beam. The balancing arm is arcuate, having its free, sheave-supporting end directed away from the outer side beam portion 13. The portion of the balancing arm adjacent to the hinge means 14 is wedge shaped, and the juxtaposed ends of the side beam portions 12, 13 are obliquely cut to mate with this wedge shaped portion, abutting directly against the same when the ramp is brought to its fully unfolded position shown at the bottom of the drawing, in which the portions of each side beam are aligned.

The angular position of the balancing arm 21 with respect to the outer beam portion 13 may be adjusted by means of a pressure fluid operated actuator 22 in a manner and for the purpose to be described herebelow.

Conduits (not shown) supplying pressure fluid to and removing fluid from the actuators are, in any well known manner, led past the hinge means 14 and 11 and are connected to governing means on board the ship.

The drawing shows the ramp in four different positions, viz:-

A fully stowed position,

B during folding, or unfolding,

C resting upon a quay when the inner hinge 11 means is located lower than the level of the quay, and D resting upon the quay when the inner hinge means 11 is located higher than the level of the quay.

In position A, the inner and outer portions of the ramp are stowed substantially vertically, with the undersides of the travelling tracks turned towards each other. In order to reach a stable rest position, the center of gravity 23 for the movable unit is brought inside of a vertical plane 24 passing through the inner hinge means 11.

In order to unfold the ramp, it is necessary that the center of gravity be brought outside of the vertical plane 24. This is performed with the aid of the balancing arms 21, of which at least one, due to its arcuate form, will abut against a positive stop 25 in the ship's superstructure. The position of the balance arm during this action is denoted by dash lines at 26.

An unfolding movement is thus initiated by extending the actuators of the balance arms fully. When the center of gravity has passed the critical plane, further movement (position B) will be braked by means of the winch wires 19. As the lowering proceeds the balancing arms are retracted towards the outer beam portions 13, which succesively increases the angle between the portions of the ramp, until the balancing arms finally, when the ramp approaches the quay, rest against the outer beam portions. In this manner, the weights of the two portions of the ramp may be balanced against each other, whereby uncontrolled movements between the two portions are avoided.

The transfer of the ramp back to its stowed position occurs in a reverse order. In the same manner as during the lowering, the weights of the ramp portions are balanced against each other by means of the arms so a smooth, steady movement to the vertical position is obtained. When fully stowed, the ramp is locked mechanically to the superstructure.

A monitoring device including warning lamps at the maneuvering post for the ramp will indicate when the operator shall perform the necessary angular adjustments.

The maneuvering winches preferably are of the self-tensioning type, which means that they will carry a certain portion of the occasional load, for instance the weight of the ramp.

Position D shows the simple case in which the inner hinge 11 is located higher than the level of the quay. The beam portions 12 and 13 are then aligned, and their juxtaposed ends rest against the wedge shaped portion of the intermediate balancing arm, whereby a practically rigid beam structure is obtained.

When the inner hinge means is located below the level of the quay, the ramp will be articulated at the midway hinge means 14 in the manner indicated by position C. The actuators 22 will then have to maintain the balancing arms in a corresponding angular position and transfer to the quay and to the inner hinge means, respectively, the forces caused by the loads being moved along the ramp.

The balancing arms shown in this embodiment must be regarded as examples only. The shape of the arms and the location of the sheaves as well as of the actuators may vary as called for by different technical prerequisites. The actuators may, thus, be mounted at the inner beam portions.

What I claim is:

1. A ship's loading ramp including two spaced substantially parallel side beams, and a travelling track carried by the side beams said side beams and said tracks being divided transversely into inner and outer portions, first hinge means for swingably mounted the inner portion of said ramp at the ship, second hinge means interconnecting the inner and outer portions of the ramp, winch means for operating the ramp between a folded and a vertically staved position on board the ship and an extended working position, and further including a balancing arm at each side beam having one end pivotably mounted thereto adjacent to the second hinge means and extending its other end above the upper edge of the side beam, a sheave means at the other end of each arm for guiding a wire from the winch means, and an actuator, mounted between one of the beam portions and the pertaining balancing arm for adjusting the angular position of the latter.

2. The loading ramp according to claim 1, including a super structure having an opening in which the inner and outer portions of the side beams are arranged so that the center of gravity of the folded and vertically stowed ramp is located inside of a vertical plane through the axis of the first hinge means which is located adjacent to the opening in the superstructure, the further improvement that the balancing arms are arcuate, said balancing arms having free ends turned towards the ship, and a positive stop in the superstructure, above the stowed ramp and opposite to at least one of the arms, the pivoting movement of which is sufficient in cooperation with said positive stop for forcing the center of gravity out beyond said vertical plane.

3. The loading ramp according to claim 1, in which each balancing arm is pivoted about the axis of the second hinge means.

4. The loading ramp according to claim 3, in which balancing arm has a part located between the inner and outer portions of the pertaining side beam, said part being wedge shaped, the juxtaposed ends of said side beam portions being obliquely formed so they will abut against the wedge shaped part of the balancing arm when the portions of the side beam are unfolded to be aligned with each other.

* * * * *